US005823289A

United States Patent [19]

Csomos

[11] Patent Number: 5,823,289

[45] Date of Patent: Oct. 20, 1998

[54] WINDOW PLATFORM AND SCAFFOLDING DEVICE

[76] Inventor: Steven Csomos, 880 Birkbeck St., Freeland, Pa. 18224

[21] Appl. No.: 770,211

[22] Filed: Dec. 19, 1996

[51] Int. Cl.[6] ..... A47L 3/02

[52] U.S. Cl. ..... 182/61; 182/53; 182/55; 182/57; 182/62

[58] Field of Search ..... 182/53, 55, 57, 182/58, 59, 60, 61, 62

[56] References Cited

U.S. PATENT DOCUMENTS

| | | | |
|---|---|---|---|
| 194,718 | 8/1877 | Palmer | 182/57 |
| 829,537 | 8/1906 | Mills | 182/61 |
| 1,189,884 | 7/1916 | Stratinsky | 182/61 X |
| 1,518,091 | 12/1924 | Mathis et al. | 182/61 X |
| 1,679,961 | 8/1928 | Embrey . | |
| 1,894,878 | 1/1933 | La Grange | 182/61 |
| 2,059,739 | 11/1936 | Ment et al. | 182/61 |
| 2,219,642 | 10/1940 | Whiteman | 182/61 X |
| 2,265,730 | 12/1941 | Hall | 182/61 |
| 2,273,370 | 2/1942 | Oberti | 182/61 X |
| 2,678,243 | 5/1954 | Masse | 182/61 X |

FOREIGN PATENT DOCUMENTS 2093107 8/1982 United Kingdom .

*Primary Examiner*—Daniel P. Stodola
*Assistant Examiner*—Richard M. Smith
*Attorney, Agent, or Firm*—Anthony J. Dixon

[57] ABSTRACT

A window mounted temporary working platform which is totally assembled by one user from inside the window being repaired, maintained, or washed. The device provides a working platform at an elevation below the outer window sill with two side rails, an outer rail and a working platform which is supported without permanent installation on the building being serviced. The device is adjustable in width to accommodate a wide variety of window widths and is configured to provide for window with outer storm windows and window installation where the area below the inner sill is unavailable for platform support or connection due to of a heater or radiator.

7 Claims, 3 Drawing Sheets

WINDOW PLATFORM AND SCAFFOLDING DEVICE

BACKGROUND OF THE INVENTION

1. Field of the Invention

The present invention relates to improvements on an improved window scaffold or working platform for use in the temporary repair, maintenance or cleaning of windows.

It is a primary object of the present invention to provide a compact, stable platform which can be easily assembled and disassembled for use when desired to access the outside of a window for repair, maintenance and cleaning.

It is a further object of the present invention to provide a platform easily assesmbled by one person from a location inside the building in which the window is installed.

It is a further object of the present invention to provide a temporary, easily assembled window platform which has a working surface below the window sill to allow for complete maintenance and cleaning without the need for dangerous stooping over or reaching by the user.

It is a further object of the invention to provide a platform to allow for outside window repair, maintenance and cleaning which does not require installation of connector means to the building either inside or outside and thereby avoids permanent disfiguration or marring of inner or outer walls.

It is a further object of the present invention to provide a window platform which can be installed at a window location where the inner area below the sill is unavailable to support the structure due to the existence of large decorative sills or heating elements such as ducts, heaters and radiators which are often located beneath windows.

These and other objects and advantages of the present invention will be more readily apparant upon review of the complete disclosure and description and drawings provided herein.

2. The Prior Art

Scaffolds or platforms have long been in use in the field of building construction, maintenance and repair. Early advances in the art of scaffolding relate back to the beginning of man's attempt to construct, decorate and repair his structures. One notable example is the scaffolding used to decorate the Sistine Chapel without marring its surface. Although the objects of the present invention are less grandiose, the use without marring the surface is a problem long existent in the field of window platform and scaffolding devices.

U.S. Pat. No. 194,718, issued to Palmer in 1877, discloses one such scaffold device; however, the complexity of the device decreases its utility to the everyday homeowner. Also, the configuration presupposes a wall of great thickness and strength to support it, a condition that does not exist in most of today's buildings, especially residences. Also Palmer has the drawback common to all of the art. The platform is at window height which means lower sill maintenance is impossible with such a device.

U.S. Pat. No. 1,679,961 issued to Embrey in 1927, discloses a window jack; however, it also suffers from the lower sill access deficiency of Palmer and, with its lack of protective rails, would be unsafe for everyday use or, use by even a skilled user.

U.K. 2,093,107, crossfiled in the United States, with a date of Feb. 17, 1982, and issued to J. J. Keyes, provides a window scaffolding device which mounts inside the window sill but it mounts below the sill which will be unusable in most homes where heating elements and the like are usually located beneath windows. The lack of central heating in many homes in the United Kingdom is not a prevalent situation in the United States. Further, the inner pad adjustments are difficult to adjust properly prior to the device exiting the window which is a serious drawback. Further, the outer adjustment pads are located where they cannot be reached. Lastly, the prior art problem of a platform below the sill level is still not addressed by the Keyes reference.

It is therefore the object of the present invention to provide an easily assembled window scaffold or platform which overcomes these problems prevalent in the prior art and provides a platform which is below the level of the sill outside the window and completely assembled by one person from inside the building wherein the window is installed.

This advantage over the previous objects and advantages will all become more readily apparant upon review of the drawings and detailed description which follow the summary of the invention.

SUMMARY OF THE INVENTION

In accordance with the present invention in its broadest aspect there is provided a window platform and scaffolding device to allow for maintenance, repair and cleaning of windows and the exterior of buildings generally, which comprises an adjustable structure which comprises:

a. an inner brace member which engages the inside of the frame in which the window is positioned;

b. a pair of side members which extend outside of the window and cause the inner brace to engage the inner frame or wall in cantilever action;

c. a platform supported by the side members of "b" which is an elevation below that of the lower window sill;

d. a pair of side rails fixed to the side members to provide a safe structure;

e. a rear brace member, preferably of adjustable width, to provide a safety rail and structural support attached to each side rail and spanning the width of the platform;

f. means for adjusting the width of the rear brace member;

g. means for connecting the rear brace to the side members;

h. means for slidingly connecting the side members to the inner brace to allow for adjustment for windows of various widths from inside the window;

i. means for fixing the connectings of "g" and "h" in fixed position once the width has been determined.

whereby a complete platform is assembled allowing access to the outside of the window completely from inside the building.

THE DRAWINGS

In order to describe the invention more fully, reference is directed to the accompanying drawings which are to be taken in conjunction with the detailed description which follows.

THE PREFERRED EMBODIMENT

Figure 1:
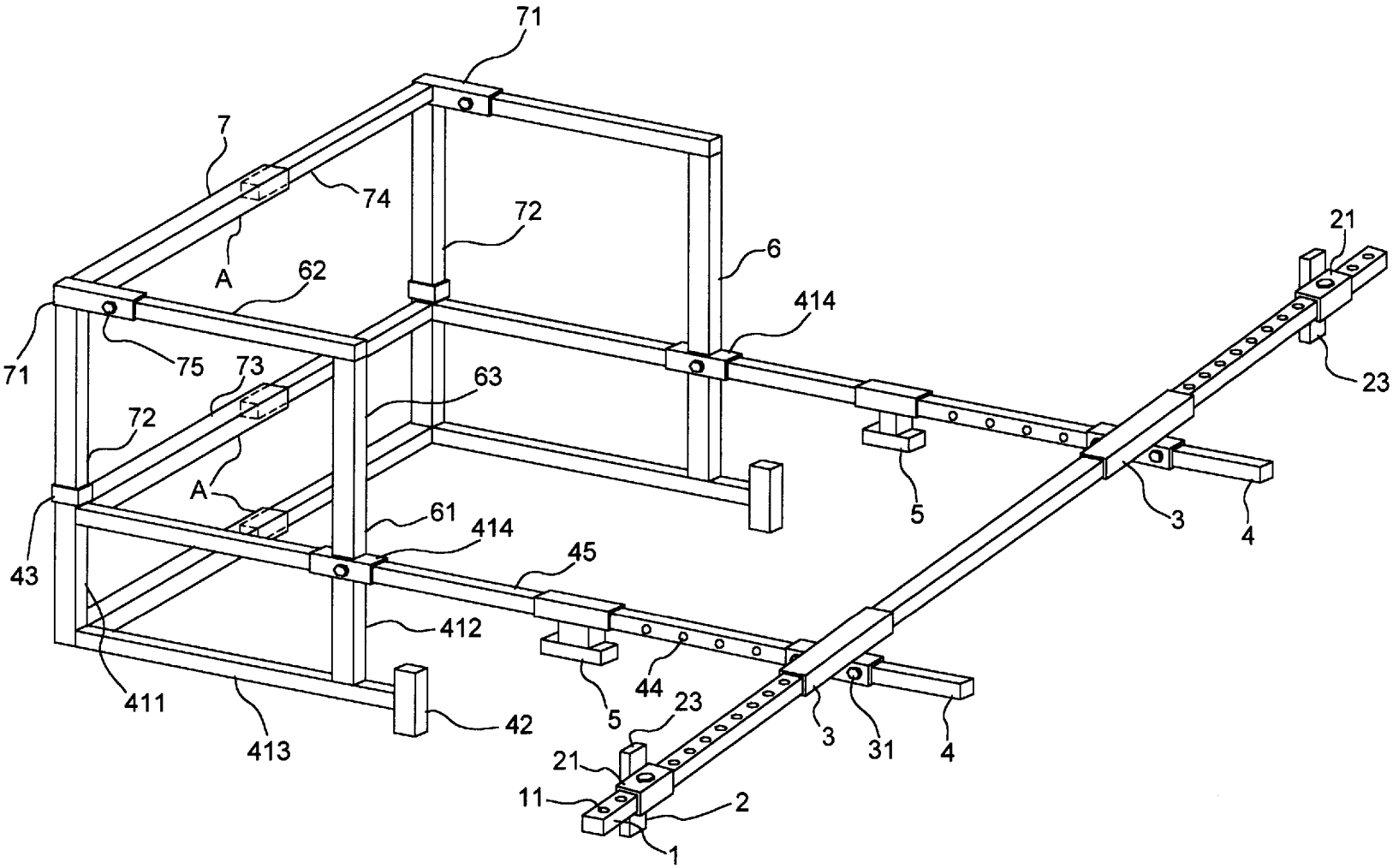
FIG. 1 is a prespective view showing the device installed and ready to use.

The device of the present invention is assembled to be used. With reference to FIG. 1, the process of assembly to a completed platform begins with placement of the inner brace, 1, in conjuction with side members, 4. The inner brace is a longitudinal member which has mounted thereon two inner pads, 2, which slide along the length of member, 1. Each of these is positioned on member, 1, at a location which will cause them to engage either the inner window frame or the wall. When this location is selected, each is fixed into place with a pin, 21, which passes through the pad, 2 and into a receiving receptacle or pin hole, 11. A series of these is provided to allow for use of the device in windows of various widths. It is also envisioned that a protector pad of rubber, foam, or similar substances can be fixedly attached to the face of pad, 2, at 23, to reduce marring of the interior of the window frame or wall, as the case may be. When these members, 2, are fixed in location, then the two side pieces, 4, can be attached to the inner brace. This is accomplished by sliding the end of each side member, 4, through the inner brace, 1, connector, 3, which is in turn slidingly mounted on the inner brace, 1. This is all being done inside the building.

Each of these side members, 4, is configured as shown on the figure with a main rail and a rectangular platform brace comprised of members 411, 412 and 413. Also, the side member has an outer pad, 42, which will engage to outside of the building. Further, receptacle, 414, is mounted on side member, 4, at the junction of member, 412 and 4. This member will be addressed below.

Further, mounted on member, 4, is foot, 5, which allows the side member to span a window sill or storm window sill as the case may be, it being understood that window casings come in a variety of configurations. The side member also has a top receptacle, 43, located at the junction of member, 4 and 411, which will be addressed below.

Figure 2:
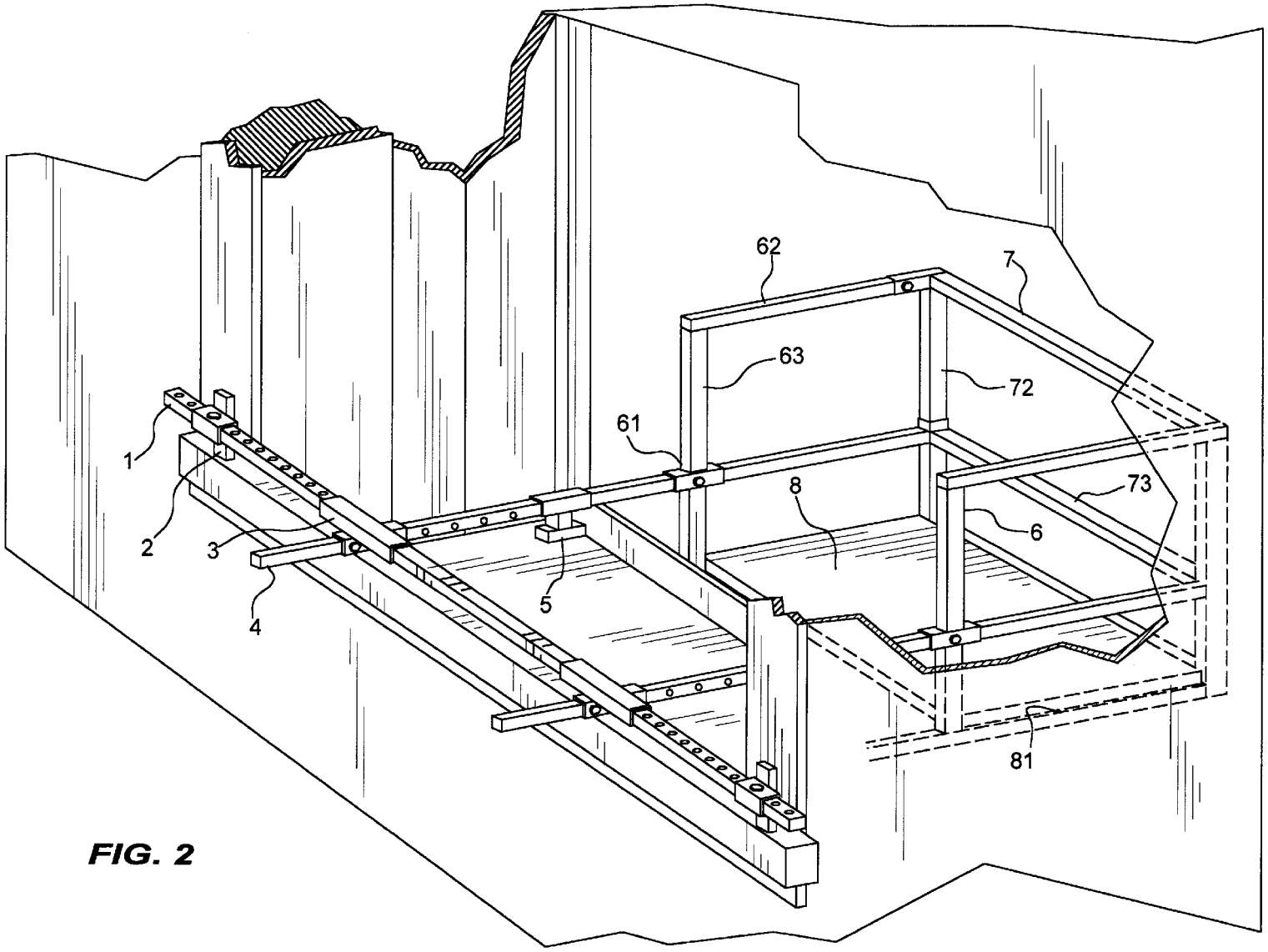
FIG. 2 is a perspective view of the device with partial assembly at a window sill.
Figure 3:
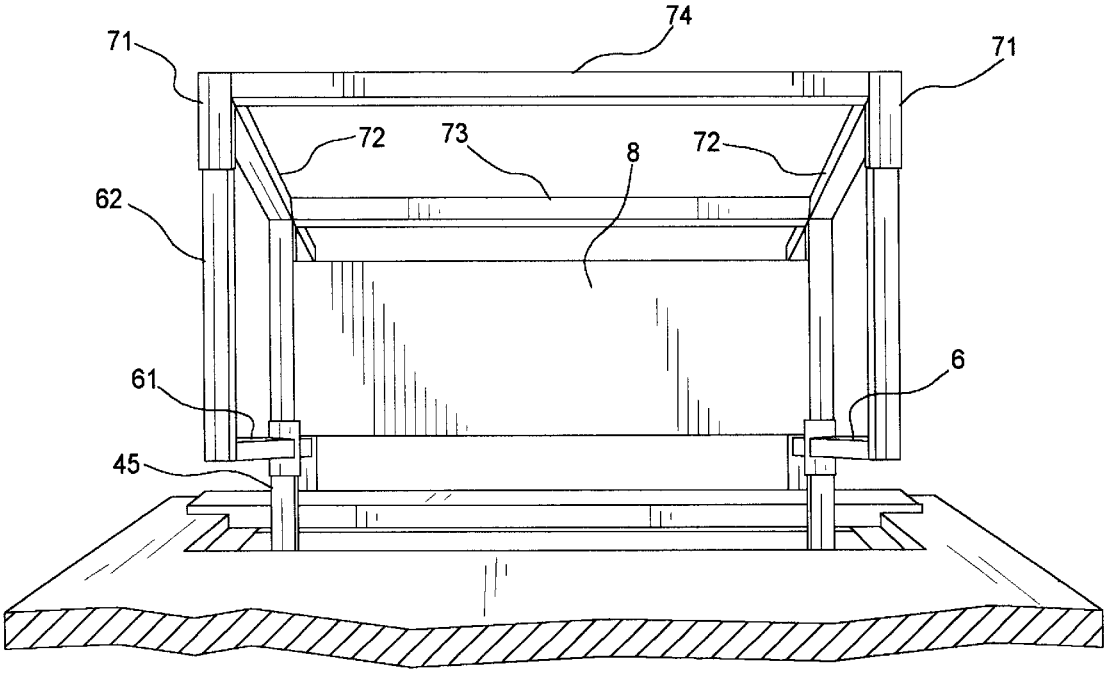
FIG. 3 is a perspective view of the device installed on a builidng.

The main advantages of the present invention are to provide an outside platform which can be assembled from the interior of the building and provide a platform which is below the level of the window sill. Each side member, 4, is slidingly mounted on the inner brace by sliding member, 4, though T-brace connector, 3. It is preferable that both side members, 4. are placed parallel to each other at a central location by sliding T-brace, 3, to the center of inner brace, 1. In this way, the user can hold both side members together. When side members, 4, have been attached to T-brace 3, the user can then place the unit at the window and cause both side members to exit. Note the side members, 4, are slid, by sliding side member, 4, and T-brace, 3, outwardly to the parallel positions at a distance from each other which matches the width of the window. Pin, 31, is then engaged into a corresponding receptacle, 44, to fix the location of members, 4, and 1, to each other. Next, foot, 5, is slid along the length of member, 4, to a location to support member, 4, above the outer sill of the window and to level member, 4. At this point, the device looks like FIG. 2. The device is held in place by pads, 2, on the inside of the window and other pads, 42, on the outer wall.

The next member to be placed is the platform, 8, which rests on members, 413, and spans the width between parallel members, 4. It is envisioned that a channel in location 81 may be defined on the bottom of the platform, 8, which is accommodatingly larger than member, 413, to provide structural stability. Note that all of this is being assembled from inside the window by one person.

The next step is the engagement of upper handle, 6, which is of L-shaped configuration with two sides, a vertical member, 63, and a horizontal member, 62. These are engaged, one with each side member, 4, by engaging end 61, into receptacle, 414, provided on side member, 4. Lastly, outer brace, 7, is installed by engaging outer brace side member, 72, into receptacles, 43 and by sliding side top member, 62, into receptacles, 71, provided on member, 7, the outer brace. The outer brace is rectangular in configuration with upper receptacles, 43, and lower spanning member, 73, which structurally supports and completes the rectangular configuration of outer brace, 7.

Upon installation of the outer brace as described, the unit is completed. Pins, 75, are then engaged to fix the connection of members, 62 and 71.

When the work requiring the platform, window cleaning, painting or the like, is completed, the unit can be disassembled by reversing the steps set forth above.

It is also envisioned that the horizontal members of outer brace, 7, they being, 74 and 73, can be of a two part configuration, slidingly mounted to each other, to allow the width of member, 7 to be adjusted. This is preferably accomplished by dividing members 73 and 74 into two parts with one part having an aperture therein accommodatingly larger than the other part, to allow for a sliding connection between the two halves of each member. See "A" in FIG. 1

It will be seen that the present device provided a convenient and stable working platform usable by home-owner and expert alike providing a safe working surface below the sill level of a window so that maintenance, repair and cleaning can be easily accomplished. Also, two or more such platforms can be installed in adjacent windows to provide for a platform along the side of the building for general maintenance by spanning the two platforms with planks or the like.

Numerous other advantages will be apparent to those skilled in the art. It is to be understood, therefore, that the present inventions is not limited to the described embodiment thereof except as defined in the claims, and that numerous variations of the present invention may be made without departing from the spirit and scope thereof.

I claim:

1. An adjustable window mounted working platform which comprises:

a. an inner brace member which engages the inside of a building in which a window is positioned;

b. a pair of side members which extend outside of the window and cause the inner brace to engage the inside of a wall in cantilever action;

c. a platform supported by the pair of side members and mounted thereon at an elevation below the elevation of a lower window sill;

d. a pair of L-shaped side handles each comprising a horizontal member and a vertical member, the vertical member mounted onto each side member;

e. a rear brace member perpendicularly attached to each L-shaped side handle horizontal member and spanning the width of the platform;

f. means for slidingly connecting the side members to the inner brace to provide adjustment to the window width from inside the window;

g. means for releasably connecting the rear brace to the side members;

h. means for fixing the the side member connecting means in a given position;

i. means for fixing the rear member connecting means in a given position whereby a complete platform is assembled at an elevation below the elevation of the window sill.

2. The adjustable window platform of claim 1 wherein the inner brace member has slidingly mounted thereon two pad members which are interdisposed between the inner brace member and the wall and which can slide to a position adjusted to the window width, and, means for fixing the pad members in a given position.

3. The adjustable window platform of claim 2 wherein each side member has slidingly mounted thereon a side support interdisposed between the side member and the window sill.

4. The adjustable window platform of claim 3 wherein the rear brace member connecting means is a receptacle on each side handle accommodatingly larger than the rear brace member and wherein the side member connecting means is a pin mounted on each side member and a series of apertures defined in each side member to receive the pin at a series of locations and wherein means for fixing the side supports to each member is a pin mounted on each side support and a series of apertures defined in the corresponding side member to receive the pin at a series of locations.

5. The adjustable window platform of claim 4 wherein the platform has defined in its underside two parallel channels each accommodatingly larger than the side members to provide a stable mounting of the platform on the side members at an elevation below the elevation of the window sill.

6. The adjustable window platform of claim 5 wherein the rear brace member further comprises means for adjusting the width of the rear brace member.

7. The adjustable window platform of claim 6 wherein the means for adjusting the width of the rear brace member further comprises a rear brace member with two halves, an aperture defined in the first half accommodatingly larger than the second half, to provide a sliding connection of the first half to the second half.

* * * * *